US007154445B2

(12) United States Patent
Littlefield et al.

(10) Patent No.: US 7,154,445 B2
(45) Date of Patent: Dec. 26, 2006

(54) OMNI-DIRECTIONAL COLLINEAR ANTENNA

(75) Inventors: Frederick H. Littlefield, Barrington, NH (US); Adam M. Alevy, Carlisle, MA (US); John R. Sanford, Encinitas, CA (US); Shawn Johnson, Allenstown, NH (US); Eugene MacDonald, Barrington, NH (US)

(73) Assignee: Cushcraft Corporation, Manchester, NH (US)

( * ) Notice: Subject to any disclaimer, the term of this patent is extended or adjusted under 35 U.S.C. 154(b) by 29 days.

(21) Appl. No.: 11/099,954

(22) Filed: Apr. 6, 2005

(65) Prior Publication Data

US 2006/0227061 A1 Oct. 12, 2006

(51) Int. Cl.
*H01Q 1/12* (2006.01)
*H01Q 21/00* (2006.01)

(52) U.S. Cl. ..... 343/725; 343/791; 343/792

(58) Field of Classification Search ..... 343/725, 343/702, 790, 791, 792
See application file for complete search history.

(56) References Cited

U.S. PATENT DOCUMENTS

| | | | | |
|---|---|---|---|---|
| 4,730,195 | A * | 3/1988 | Phillips et al. | 343/792 |
| 5,926,149 | A * | 7/1999 | Rummeli et al. | 343/791 |
| 5,949,383 | A * | 9/1999 | Hayes et al. | 343/795 |
| 5,977,928 | A * | 11/1999 | Ying et al. | 343/790 |
| 6,552,692 | B1 * | 4/2003 | Zeilinger et al. | 343/792 |
| 6,686,892 | B1 * | 2/2004 | Lopez et al. | 343/791 |
| 7,064,728 | B1 * | 6/2006 | Lin et al. | 343/792 |

* cited by examiner

*Primary Examiner*—Tan Ho
(74) *Attorney, Agent, or Firm*—Hayes Soloway PC

(57) ABSTRACT

An antenna includes a differential transmission line and a center conductor, where the center conductor is at least partially contained within the differential transmission line and at least partially protruding therefrom. A first conductive flat element is connected to the center conductor and a flat meander-line structure is integral with the first conductive flat element. In addition, a second conductive flat element is integral with the flat meander-line structure.

18 Claims, 5 Drawing Sheets

OMNI-DIRECTIONAL COLLINEAR ANTENNA

FIELD OF THE INVENTION

The present invention generally relates to antennas and, more specifically, to collinear antennas.

BACKGROUND OF THE INVENTION

With advancements in technology, antennas have changed in size and range. One specific category of antenna that may be used to provide two-way communication is the omnidirectional collinear array. These antennas typically consist of multiple radiators placed end-to-end and fed in phase.

FIG. 1 is a cross-sectional view of a collinear antenna 10 commonly used for two-way communication. The collinear antenna 10 has a differential transmission line 24 attached to a feed point 14 so as to excite a lower coaxial sleeve 16 and an upper radiator segment 18. A phasing inductor 20 and a series-appended radiator 22 extends from the upper radiator segment 18. The collinear antenna 10 may be described as, but not limited to, a traditional five-eighths-wave over half-wave series-fed collinear antenna. This collinear antenna configuration exhibits gain over a basic sleeve dipole, but also yields undesirable increases in driving resistance and element Q. These characteristics result in an impedance mismatch and a reduction in useful bandwidth.

In order to counter the resulting mismatch and restore efficient radio frequency-power transfer, it is common practice to implement a tuned impedance-matching network between the feed point and the coaxial feedline. Unfortunately, this addition introduces higher manufacturing cost, greater structural complexity, reduced operating bandwidth, and increased radio frequency losses.

Also, in order to faithfully replicate resonant microwave circuitry, antennas of this type may be wholly or partially constructed as a printed circuit board (PCB) based strip line structure. PCB construction offers the advantage of accurate high-volume replication, but the liabilities of constructing radio frequency networks and radiators on a PCB are also well known. Specifically, two-dimensional strip line sleeves generally yield inferior common-mode rejection when compared to a fully surrounding cylindrical sleeve. More significantly, virtually any PCB substrate material one might select will introduce greater dielectric loss than a structure constructed in the dielectric medium of air. The amount of loss is usually related inversely to price. When a PCB substrate material with high dissipation losses, such as FR4, is introduced for the purpose of minimizing antenna cost, losses will be relatively high and may prove unacceptable. Conversely, when a low-dissipation material is used to control losses, the cost may prove prohibitive.

Thus, a heretofore unaddressed need exists in the industry to consider and address the aforementioned deficiencies and inadequacies.

SUMMARY OF THE INVENTION

Embodiments of the present invention provide a system and method for providing a collinear antenna.

Briefly described, in architecture, one embodiment of the system, among others, can be implemented as follows. An antenna includes a differential transmission line and a center conductor, where the center conductor is at least partially contained within the differential transmission line and at least partially protruding therefrom. A first conductive flat element is connected to the center conductor and a flat meander-line structure is integral with the first conductive flat element. In addition, a second conductive flat element is integral with the flat meander-line structure. The present invention can also be viewed as providing a method of assembling an antenna, the method comprising the steps of: forming a first conductive flat element, a meander-line structure, and a second conductive flat element, wherein the first conductive flat element and the second conductive flat element are connected by the meander-line structure; sliding a cylindrical dipole sleeve over a differential transmission line, wherein the differential transmission line has a center conductor therein, such that the center conductor at least partially protrudes from the differential transmission line and the cylindrical dipole sleeve; and connecting the center conductor to the first conductive flat element.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
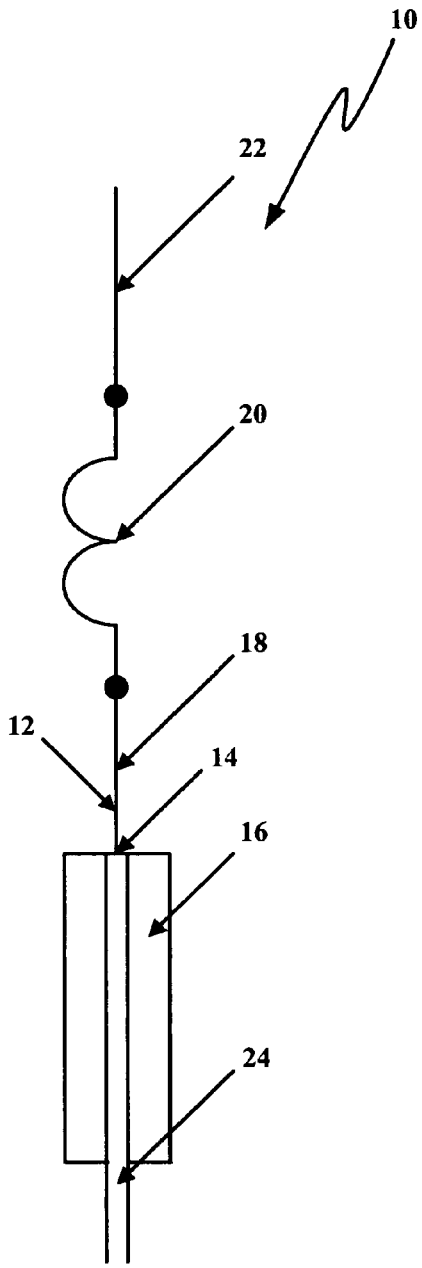
FIG. 1 (PRIOR ART)
FIG. 1 is a cross-sectional view of a collinear antenna in accordance with the prior art.
Figure 2:
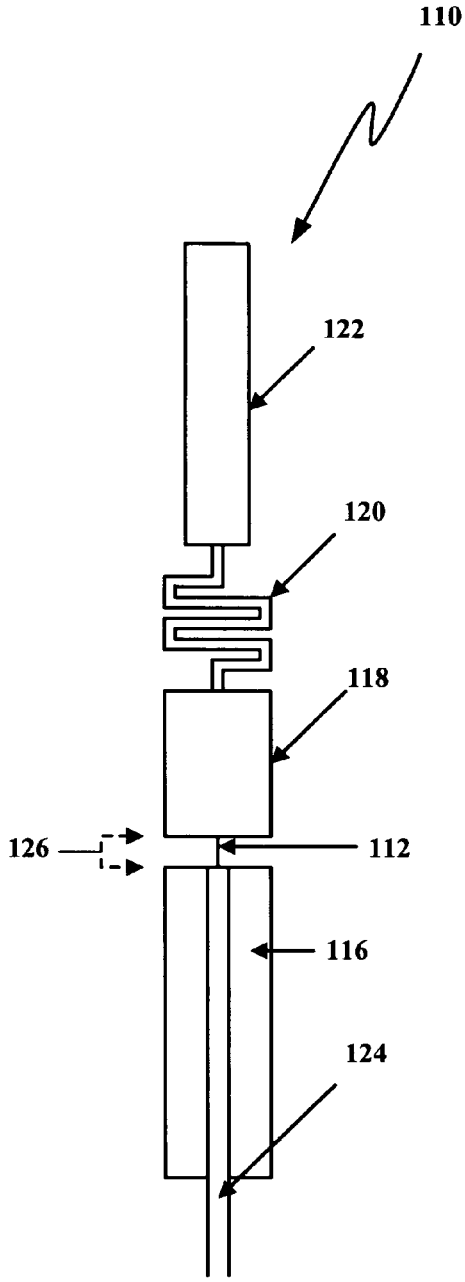
FIG. 2 is a cross-sectional view of a collinear antenna, in accordance with a first exemplary embodiment of the present invention.

FIG. 2 is a cross-sectional view of a collinear antenna 110, in accordance with a first exemplary embodiment of the present invention. The collinear antenna 110 includes a cylindrical dipole sleeve 116. A center conductor 112 is at least partially contained within a differential transmission line 124, where the differential transmission line 124 is located at least partially within the cylindrical dipole sleeve 116. The center conductor 112 also at least partially protrudes from the differential transmission line 124. Alternatively, the differential transmission line 124 may be referred to as a feed line. A first flat element 118 is connected to the center conductor 112. A flat meander-line structure 120 is integral with the first flat element 118. A second flat element 122 is integral with the flat meander-line structure 120. The antenna 110 may be described as, for example, a five-eighths-wave over half-wave series-collinear antenna.

The cylindrical dipole sleeve 116 may, for example, be formed at the end of the differential transmission line 124, where the differential transmission line 124 may be, for example, but not limited to, a standard 50-Ohm coaxial cable. The cylindrical dipole sleeve 116 may be formed from a crimp structure. Using a crimp structure may allow, for instance, faster, more efficient, and safer assembly methods than structures designed for soldering. Those having ordinary skill in the art may know of other methods and apparatus for making and assembling the cylindrical dipole sleeve 116 without deviating from the intent of the invention.

The first flat element 118, the flat meander-line structure 120, and the second flat element 122 are collectively referred to herein as the stamped component. The stamped component may be rigid in form. The stamped component may, for instance, be formed from a single low-cost thin-sheet conductive metal to minimize costs. In addition, the stamped component may be formed by a precision stamping process instead of photo-etching. Precision stamping provides tighter control over dimensional tolerances as well as greater dimensional stability and higher repeatability. The unified stamped component may be self-supporting in the dielectric medium of air.

Form factor for the first flat element 118 and second flat element 122 may be determined by Euclidean methodology, predictive computer modeling, or through advanced GA-based modeling techniques, or any other method, so as to optimize the antenna for impedance match and bandwidth.

Figure 3:
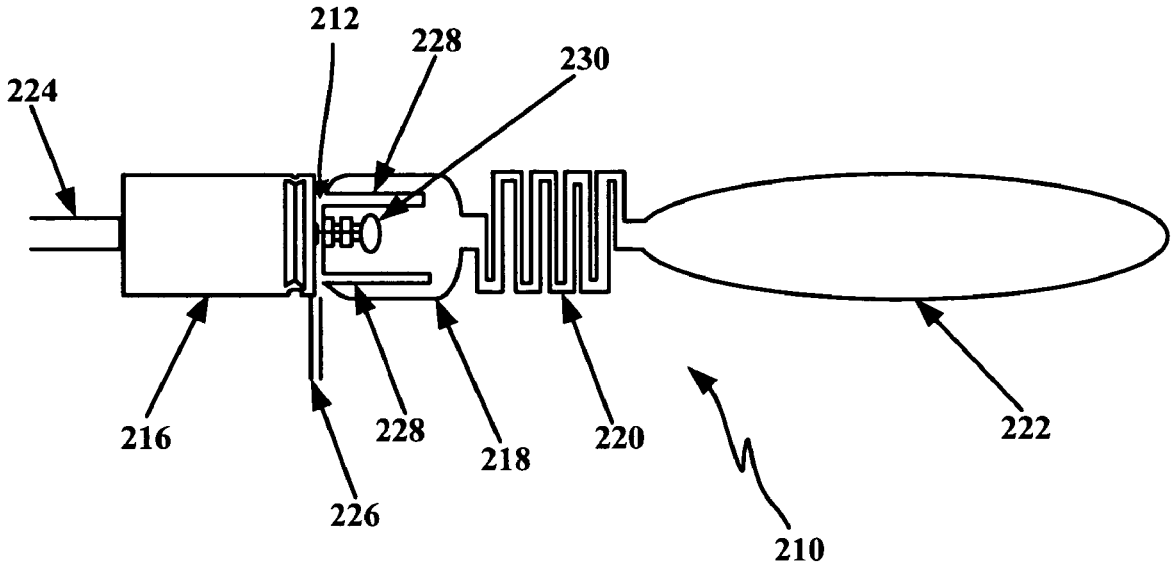
FIG. 3 is a cross-sectional view of a collinear antenna, in accordance with a second exemplary embodiment of the present invention.

The first flat element 118 provides one leg of a sleeve dipole launch element for the collinear antenna 110. Prospective variations in the configuration of this first flat element 118 are shown in FIG. 3 to include the addition of coplanar slots 228 and strategic rounding of the overall form of the first flat element 218. Referring back to FIG. 2, the spacing of gap 126 formed between the edge of the first flat element 118 and the surface of cylindrical dipole sleeve 116 constitutes a design parameter that is controlled through use of a precision assembly fixture. This fixture may be applied by anyone known to have ordinary skill in the art to ensure dimensional repeatability. It should be noted that the first flat element 118 might have a different configuration.

The flat meander-line phasing structure 120 may be formed between the first flat element 118 and the second flat element 122 as an integrated part of the monolithic structure so as to eliminate the need for an externally appended network requiring mechanical and electrical bonding. Eliminating this need permits a single direct connection from the center conductor 112 of the differential transmission line 124 to the first flat element 118, while maintaining functionality of the antenna 110. As is shown by FIG. 2, the form factor of the meander-line structure 120 is typical and conformal for standard printed-circuit layout and design practice, but with the unique exception that it is implemented as a self-supporting coplanar structure and adjusted for the dielectric constant of air. Specifically, the meander-line structure 120 may have different shapes as long as it fulfills the requirement of performing phase shift while radiating minimal RF energy.

The second flat element 122 may also exhibit one of many different shapes. As an example, FIG. 2 illustrates the second flat element 122 as having a rectangular shape. Alternatively, as is shown by FIG. 3, the second flat element 222 may have an oval-shaped periphery. In addition, the second flat element 222 may be T-shaped. One having ordinary skill in the art would appreciate that the second flat element 222 may have a different shape from the specific shapes illustrated by FIG. 2 and FIG. 3 while concurrently yielding desirable impedance and bandwidth characteristics. Specifically, referring to FIG. 2, it is desirable that a composite impedance derived by adding an impedance of the first flat element 118 to an impedance of the second flat element 122, be similar to the impedance of the differential transmission line 124. As a result, similar to the first flat element 118, the second flat element 122 is illustrated as having a relatively large cross-sectional area to lower driving resistance and reduce Q. Of course, other shapes may be used for the first flat element 118 and the second flat element 122.

FIG. 3 is a cross-sectional view of a collinear antenna 210, in accordance with a second exemplary embodiment of the present invention. The collinear antenna 210 includes a cylindrical dipole sleeve 216. The cylindrical dipole sleeve 216 may be installed at an end of a differential transmission line 224, as an example, a standard 50-Ohm coaxial cable. Different cables may also be used. A center conductor 212 is at least partially contained within the differential transmission line 224 and at least partially protrudes therefrom, where the differential transmission line 224 is at least partially located within the cylindrical dipole sleeve 216. A first flat element 218 is connected to the conductor 212 via use of a solder-style V crimp 230, as is explained in further detail below with reference to the description of FIG. 4.

The first flat element 218 is shaped strategically and formed with slots 228 for the purpose of enhancing bandwidth and improving impedance match. This first flat element 218 is separated from the cylindrical dipole sleeve 216 by a space 226. A flat meander-line structure 220 is integral with the first flat element 218. A second flat element 222 is integral with a far end of the flat meander-line structure 220. The second flat element 222 is also shaped to work in conjunction with the first flat element 218 to provide an improved impedance match with an impedance of the differential transmission line 224. The design of the second exemplary embodiment, shown in FIG. 2, results in a freestanding metal radiating structure that offers significant dimensional repeatability at a relatively low cost.

The first flat element 218, the flat meander-line structure 220, and the second flat element 222 are collectively referred to herein as the stamped component, as in the first collinear antenna 110 of the first exemplary embodiment of the invention.

Figure 4:
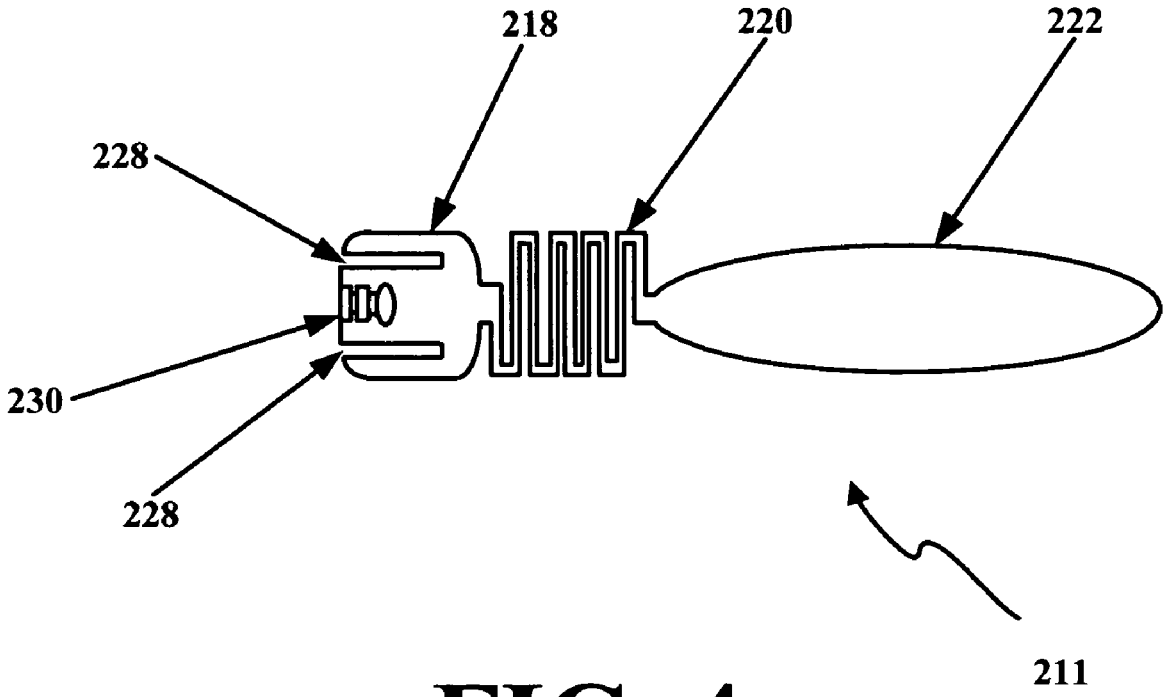
FIG. 4 is a cross-sectional view of a portion of the collinear antenna, in accordance with the second exemplary embodiment of the present invention.

FIG. 4 depicts the stamped component 211 of the collinear antenna 210, in accordance with the second exemplary embodiment of the present invention. The stamped component 211 includes the solder-style V crimp 230 coined into the first flat element 218. The V crimp 230 is known to those having ordinary skill in the art as one mechanism for providing connection to a differential transmission line 224 (FIG. 3) center conductor 212 (FIG. 3). Other mechanisms known to those having ordinary skill in the art are similarly contemplated for making connections between the center conductor 212 and the first flat element 218.

Figure 5:
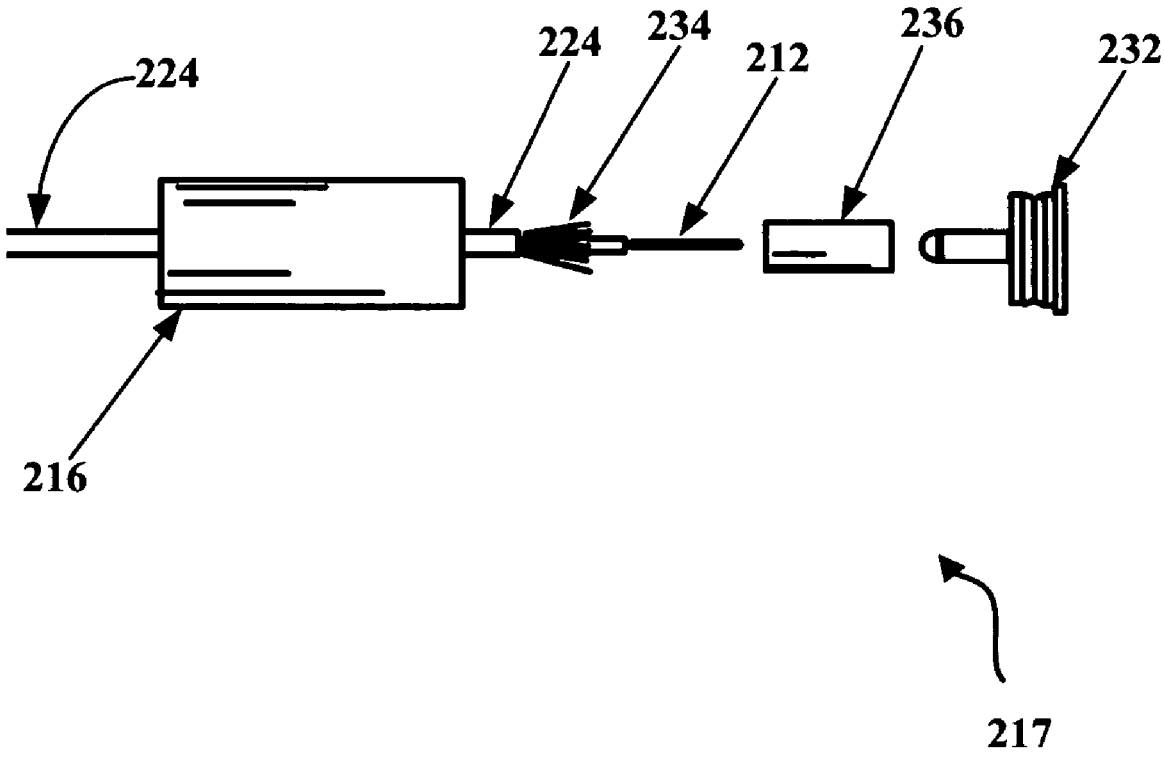
FIG. 5 is an exploded view of a portion of the collinear antenna, in accordance with the second exemplary embodiment of the present invention.

FIG. 5 is an exploded view of a dipole sleeve assembly portion 217 of the collinear antenna 210, in accordance with the second exemplary embodiment of the present invention. The decoupling characteristics of the dipole sleeve 216 compared to decoupling offered by strip-line or coplanar implementations are known to those having ordinary skill in the art. Conventional hand soldering of the components of this portion of the collinear antenna 210 slows assembly and limits the high-volume manufacturing. The components shown in FIG. 5 may be mechanically crimped components instead of soldered components, as present manufacturing technology has made mechanical crimping faster with reduced hazard to the assembler. However, both mechanical crimping and soldering manufacturing techniques are contemplated by the present invention.

FIG. 5 shows a pre-stripped coaxial cable (i.e., the differential transmission line 224) inserted into a machined cable clamp 232, which forms a top end of the dipole sleeve assembly portion 217. A cable shield 234 is then crimped in place in the manner of a coaxial connector using a standard crimp sleeve 236 and tooling known to one having ordinary skill in the art. The coaxial dipole sleeve 216 is then installed over the cable clamp 232 and pneumatically crimped in place. The completed dipole-sleeve assembly portion 217 is connected to the stamped component 211 (FIG. 4) using the conductor 212.

Figure 6:
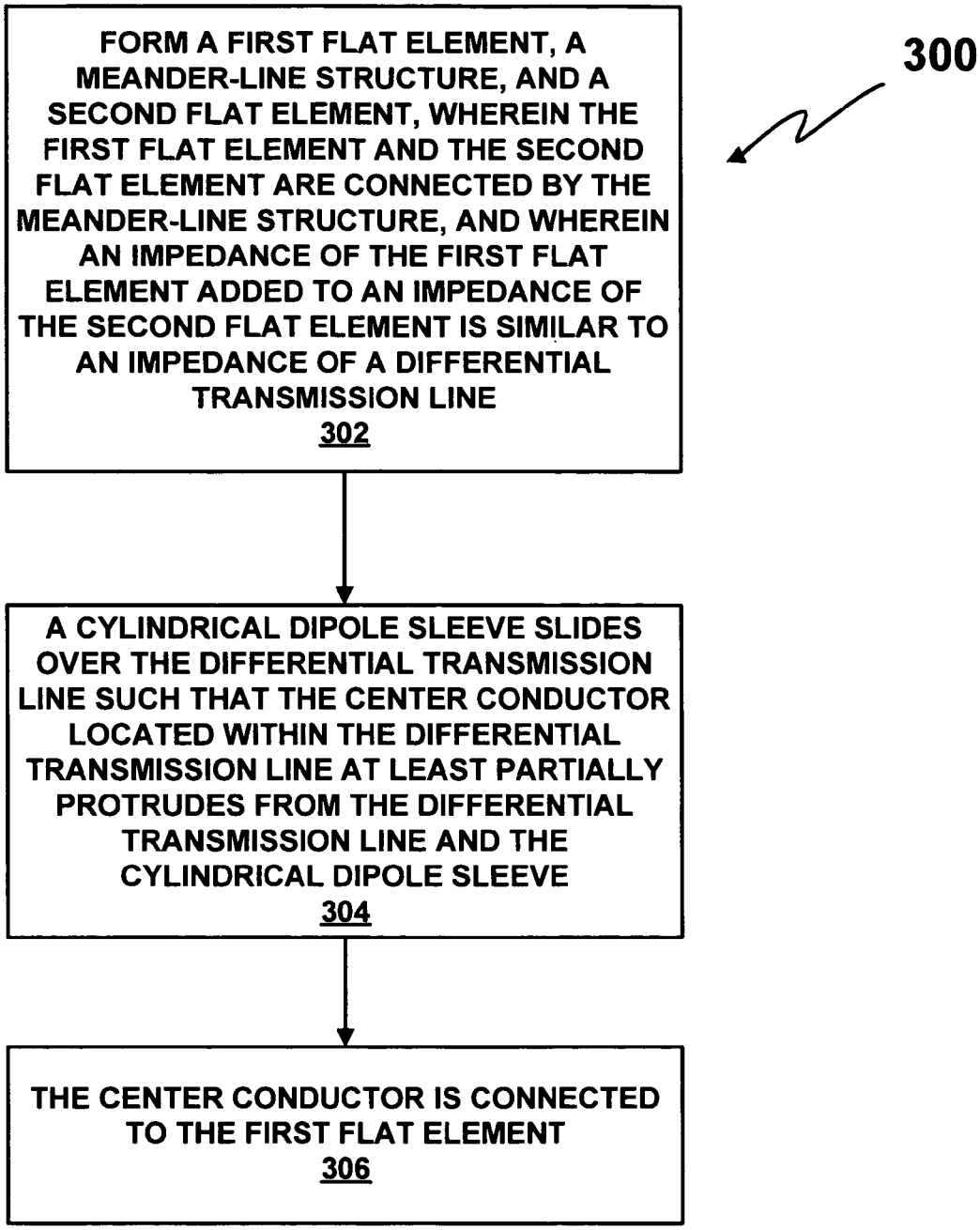
FIG. 6 is a flow chart showing one method for manufacturing the collinear antenna of FIG. 2.

The flow chart of FIG. 6 shows the assembly of a possible implementation of the collinear antenna 110 (FIG. 2), in accordance with the first exemplary embodiment of the present invention. In this regard, each block represents a module, segment, or step, which comprises one or more instructions for implementing the specified function. It should also be noted that in some alternative implementations, the functions noted in the blocks might occur out of the order noted in FIG. 6. For example, two blocks shown in succession in FIG. 6 may in fact be executed substantially concurrently or the blocks may sometimes be executed in the reverse order, depending upon the functionality involved, as will be further clarified herein.

As shown in FIG. 6 and FIG. 2, a method 300 for assembly of a collinear antenna includes forming a first conductive flat element 118, a meander-line structure 120, and a second conductive flat element 122, wherein the first conductive flat element 118 and the second conductive flat element 122 are connected by the meander-line structure 120, and wherein an impedance of the first flat element 122 added to an impedance of the second flat element 118 is similar to an impedance of a differential transmission line 124 (block 302). A cylindrical dipole sleeve 116 slides over the differential transmission line 124, where the differential transmission line 124 has a center conductor 112 therein at least partially extending therefrom, such that the center conductor 112 at least partially protrudes from the differential transmission line 124 and the cylindrical dipole sleeve 116 (block 304). The center conductor 112 is connected to the first flat element 118 (block 306).

Assembling the collinear antenna 110 may also include leaving a space 126 between the cylindrical dipole sleeve 116 and the first conductive flat element 118. The first conductive flat element 118, the meander-line structure 120, and the second conductive flat element 122 may be formed from a single piece of metal. The first flat element 118, the meander-line structure 120, and the second flat element 122 may be formed from multiple pieces of metal, other conductive materials, and bonded together. The first flat element 118, the meander-line structure 120, and the second flat element 122 may be supported in a dielectric medium of air, although supporting the stamped components on a substrate is also contemplated. The first flat element 118 may have slots and/or a solder-style V crimp formed therein.

Assembling the collinear antenna 110 may also include inserting an at least partially stripped coaxial cable (i.e., the differential transmission line 124) in a cable clamp such that the center conductor 112 in the coaxial cable at least partially protrudes from the cable clamp. A crimp sleeve can then be crimped over the coaxial cable to hold in place a cable shield of the coaxial cable. The cylindrical dipole sleeve 116 may then be crimped into place. These connections may similarly be made with solder style connections replacing some or all of the crimping connections.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. An antenna, comprising:

a cylindrical dipole sleeve;

a differential transmission line;

a center conductor at least partially contained within the differential transmission line and at least partially protruding therefrom;

a first conductive flat element connected to the center conductor;

a flat meander-line structure integral with the first conductive flat element; and a second conductive flat element integral with the flat meander-line structure.

2. The antenna of claim 1, further comprising at least one slot formed in the first conductive flat element.

3. The antenna of claim 1, further comprising a solder-style V crimp coined into the first conductive flat element.

4. The antenna of claim 1, wherein the first conductive flat element is a half-wave element and the second conductive flat element is a five-eighths-wave element.

5. The antenna of claim 1, further comprising a machined cable clamp having the center conductor inserted therein, wherein the machined cable clamp is crimped to the cylindrical dipole sleeve.

6. The antenna of claim 1, wherein a space is located between the cylindrical dipole sleeve and the first conductive flat element.

7. The antenna of claim 1, wherein the first conductive flat element, the flat meander-line structure, and the second conductive flat element are formed from a single piece of metal.

8. The antenna of claim 1, wherein the second conductive flat element further comprises an oval-shaped periphery.

9. The antenna of claim 1, wherein the first conductive flat element, the flat meander-line structure, and the second conductive flat element are supported in a dielectric medium of air.

10. The antenna of claim 1, wherein a composite impedance derived by adding an impedance of the first conductive flat element to an impedance of the second conductive flat element is similar to an impedance of the differential transmission line.

11. A method of assembling an antenna, the method comprising the steps of:

forming a first conductive flat element, a meander-line structure, and a second conductive flat element, wherein the first conductive flat element and the second conductive flat element are connected by the meander-line structure;

sliding a cylindrical dipole sleeve over a differential transmission line, wherein the differential transmission line has a center conductor therein, such that the center conductor at least partially protrudes from the differential transmission line and the cylindrical dipole sleeve; and connecting the center conductor to the first conductive flat element.

12. The method of claim 11, further comprising the step of leaving a space between the cylindrical dipole sleeve and the first conductive flat element.

13. The method of claim 11, wherein the step of forming the first conductive flat element, the meander-line structure, and the second flat element further comprises the step of forming the first conductive flat element, the meander-line structure, and the second conductive flat element from a single piece of metal.

14. The method of claim 11, further comprising the step of supporting the first conductive flat element, the meander-line structure, and the second conductive flat element in a dielectric medium of air.

15. The method of claim 11, further comprising the step of forming slots in the first conductive flat element.

16. The method of claim 11, further comprising the step of coining a solder-style V crimp into the first conductive flat element.

17. The method of claim 11, further comprising the steps of:

inserting the differential transmission line in a cable clamp such that the center conductor in the differential transmission line at least partially protrudes from the cable clamp;

crimping a crimp sleeve over the differential transmission line to hold in place a cable shield of the differential transmission line; and crimping the cylindrical dipole sleeve in place.

18. The method of claim 11, wherein a composite impedance derived by adding an impedance of the first conductive flat element to an impedance of the second conductive flat element is similar to an impedance of the differential transmission line.

* * * * *